US007246890B2

(12) United States Patent
Yamada et al.

(10) Patent No.: US 7,246,890 B2
(45) Date of Patent: Jul. 24, 2007

(54) DETECTION DEVICE FOR DETECTING EJECTION CONDITION OF NOZZLES

(75) Inventors: Takahiro Yamada, Hitachinaka (JP); Shinya Kobayashi, Hitachinaka (JP); Hitoshi Kida, Hitachinaka (JP); Kunio Satou, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 205 days.

(21) Appl. No.: 10/808,550

(22) Filed: Mar. 25, 2004

(65) Prior Publication Data

US 2004/0207676 A1 Oct. 21, 2004

(30) Foreign Application Priority Data

Mar. 25, 2003 (JP) ..... P2003-082020

(51) Int. Cl.
*B41J 2/09* (2006.01)

(52) U.S. Cl. ..... 347/77; 347/54; 347/74; 347/76; 347/81

(58) Field of Classification Search ..... 347/81, 347/77

See application file for complete search history.

(56) References Cited

U.S. PATENT DOCUMENTS

| | | | | |
|---|---|---|---|---|
| 3,769,630 | A * | 10/1973 | Hill et al. | 347/80 |
| 3,898,673 | A * | 8/1975 | Haskell | 347/80 |
| 4,392,142 | A * | 7/1983 | Seachman et al. | 347/81 |
| 4,638,325 | A * | 1/1987 | Schneider et al. | 347/75 |
| 4,990,932 | A * | 2/1991 | Houston | 347/81 |

FOREIGN PATENT DOCUMENTS

| | | |
|---|---|---|
| JP | 2001-47622 | 2/2001 |
| JP | 2001-212970 | 8/2001 |
| JP | 2002-103627 | 4/2002 |

* cited by examiner

*Primary Examiner*—Stephen Meier
*Assistant Examiner*—Brian J. Goldberg
(74) *Attorney, Agent, or Firm*—Whitham, Curtis, Christofferson & Cook, PC

(57) ABSTRACT

When an refresh ink droplet ejected from a nozzle and deflected by an inclined electric field impinges on a orifice electrode/ink receiving member, electric charge is discharged from the refresh ink droplet, thereby an electric current is generated. A current-voltage converter/amplifier detects the electric current and outputs a detection signal. A defective-condition determining circuit determines an ejection condition of a nozzle element based on voltage value of the detection signal.

26 Claims, 11 Drawing Sheets

DETECTION DEVICE FOR DETECTING EJECTION CONDITION OF NOZZLES

BACKGROUND OF THE INVENTION

1. Field of the Invention

The present invention relates to a detection device and an inkjet recording device, and more specifically to a detection device and a high-speed inkjet recording device that includes the detection device capable of detecting ink-ejection condition of nozzles in precise manner without requiring halt of printing operations.

2. Related Art

Line-scan inkjet printers are a type of high-speed inkjet printer capable of printing on a continuous recording sheet at high speed, and include an elongated inkjet recording head formed with rows of nozzles for ejecting ink droplets. The head is arranged in confrontation with the surface of the recording sheet across the entire width of the recording sheet. The head selectively ejects ink droplets from the nozzles based on a recording signal and impinges the droplets on desired positions across the width of the recording sheet. At the same time, the recording sheet is transported rapidly in its lengthwise direction, which serves as a main scanning operation, so that images can be recorded at any place on the recording sheet.

Various types of line-scan inkjet printers have been proposed, such as printers that use a continuous inkjet type recording head and printers that use a drop-on-demand type recording head. Although drop-on-demand type line-scan inkjet printers have a slower printing speed than do continuous inkjet type line-scan inkjet printers, they have an extremely simple ink system and so are well suited for a general-purpose high-speed printer.

A drop-on-demand type inkjet recording head disclosed in Japanese Patent-Application Publication No. 2001-47622 is formed with a plurality of nozzles each in fluid communication with an ink chamber and ejects ink droplets through the nozzles by applying driving voltages to energy generation elements, such as piezoelectric elements or heat elements.

In this type of recording head having a plurality of nozzles, when ink ejection condition of one of the nozzles becomes poor, then overall printing quality will be greatly degraded due to undesirable while line appearing throughout printed pages, uneven color density, or the like. For example, a nozzle becomes unable to eject ink droplets when the nozzle clogs up or when air bubbles reside in the nozzle. Also, ejected ink droplets are misdirected when the nozzle partially clogs or when a nozzle surface of the head vicinity of the nozzle is unevenly wet with ink.

In order to prevent such ejection failure, there has been proposed to prevent ink from clinging on a nozzle surface by using a water-repellent recording head or to periodically perform purging operations or wiping operations. However, it has been difficult to completely remove causes of ejection failure.

In view of foregoing, there has also been proposed a detection device that monitors ink ejection condition of each nozzle to detect a defective nozzle. For example, Japanese Patent-Application Publication No. 2001-212970 discloses a detection device that detects ink ejection condition for use in a serial printer. The detection device moves a recording head to a predetermined home position and detects ink ejection condition of each nozzle based on ink droplets ejected from the recording head at the home position. Theoretically, it is possible to use the detection device in a line scan printer.

Japanese Patent-Application Publication No. 2002-103627 discloses a different type of detection device for use in a line scan printer. This detection device utilizes minute ink droplets, such as ink mist generated when abnormal ink ejection occurs. That is, even if a nozzle has become defective, the nozzle usually does not become totally incapable of ink ejection at once, and even defective nozzle can eject ink droplets for a while, albeit in defective manner, causing ink splash or misdirected ink droplets. When such a minute ink droplet impinges on a deflection electrode provided in confrontation with a nozzle row, then an air current is generated in the deflection electrode, based on which poor ink ejection condition can be detected.

However, because the detection device disclosed in Japanese Patent-Application Publication No. 2001-212970 moves the recording head to the home position for detecting the ejection condition, it is necessary to stop printing operations. This decreases throughput of printing. Also, it is difficult to precisely stop and restart scanning movement of the recording head during printing operations in a high-speed line scan printer, the printing operation should not be stopped in a middle of printing. Accordingly, using the detection device disclosed in Japanese Patent-Application Publication No. 2001-212970 in a high-speed line scan printer is not practical.

On the other hand, ink ejection condition can be detected without stopping printing operations when the detection device of Japanese Patent-Application Publication No. 2002-103627 is used. However, if a nozzle becomes incapable of ejecting ink all of a sudden, before causing any ink splash or the like, then the detection device cannot detect defectiveness of the nozzle. Also, if ink mist bounces off a sheet surface and clings on the electrode, then the detection device may erroneously detect a normal nozzle as a defective nozzle.

SUMMARY OF THE INVENTION

It is an object of the present invention to overcome the above problems, and also to provide a detection device and an inkjet recording device including the detection device capable of reliably and accurately detecting ink ejection condition of nozzles without stopping printing operations.

In order to achieve the above and other objects, according to one aspect of the present invention, there is provided a detection device for detecting ejection condition of an ejection member of a drop-on-demand type inkjet recording device. The detection device includes a controller that controls the ejection member to eject a refresh ink droplet, a collector that collects the refresh ink droplet, a reflection means for reflecting the refresh ink droplet such that the reflected refresh ink droplet impinges on the collector, a detecting means for detecting an ejection condition of the ejection member based on the refresh ink droplet.

There is also provided an inkjet recording device including an ejection member for ejecting a refresh ink droplet, a controller that controls the ejection member to eject the refresh ink droplet, a collector that collects the refresh ink droplet, a reflection means for reflecting the refresh ink droplet such that the reflected refresh ink droplet impinges on the collector, a detecting means for detecting an ejection condition of the ejection member based on the refresh ink droplet.

BRIEF DESCRIPTION OF THE DRAWINGS

In the drawings:

FIG. 5(*a*') shows refresh ink droplets ejected from a nozzle of the head module;

FIG. 5(*b*) is a timing chart showing a driving control signal;

FIG. 5(*c*) is a timing chart showing a charging/deflecting signal applied to a back electrode;

FIG. 5(*d*) is a timing chart showing a detection signal output from a refresh-ink ejection condition detection circuit;

FIG. 6(*b*) is a timing chart showing ideal ejection timing of refresh ink droplets for a nozzle n+1;

FIG. 6(*c*) is a timing chart showing ideal ejection timing of refresh ink droplets for a nozzle n+2;

FIG. 6(*d*) is a timing chart showing a charging/deflecting signal;

FIG. 6(*e*) is a detection signal for when all of the nozzles are normal;

FIG. 6(*f*) is a detection signal for when an ejection condition of the nozzle n+1 is abnormal;

FIG. 7(*a*') shows refresh ink droplets ejected from a nozzle;

FIG. 7(*b*) is a timing chart showing a drive control signal;

FIG. 7(*c*) is a timing chart showing a charging/deflecting signal applied to the back electrode;

FIG. 7(*d*) is a timing chart showing a detection signal output from the refresh-ink ejection condition detection circuit;

FIG. 8(*a*') shows refresh ink droplets ejected from a nozzle;

FIG. 8(*b*) is a timing chart showing a drive control signal;

Figure 8:
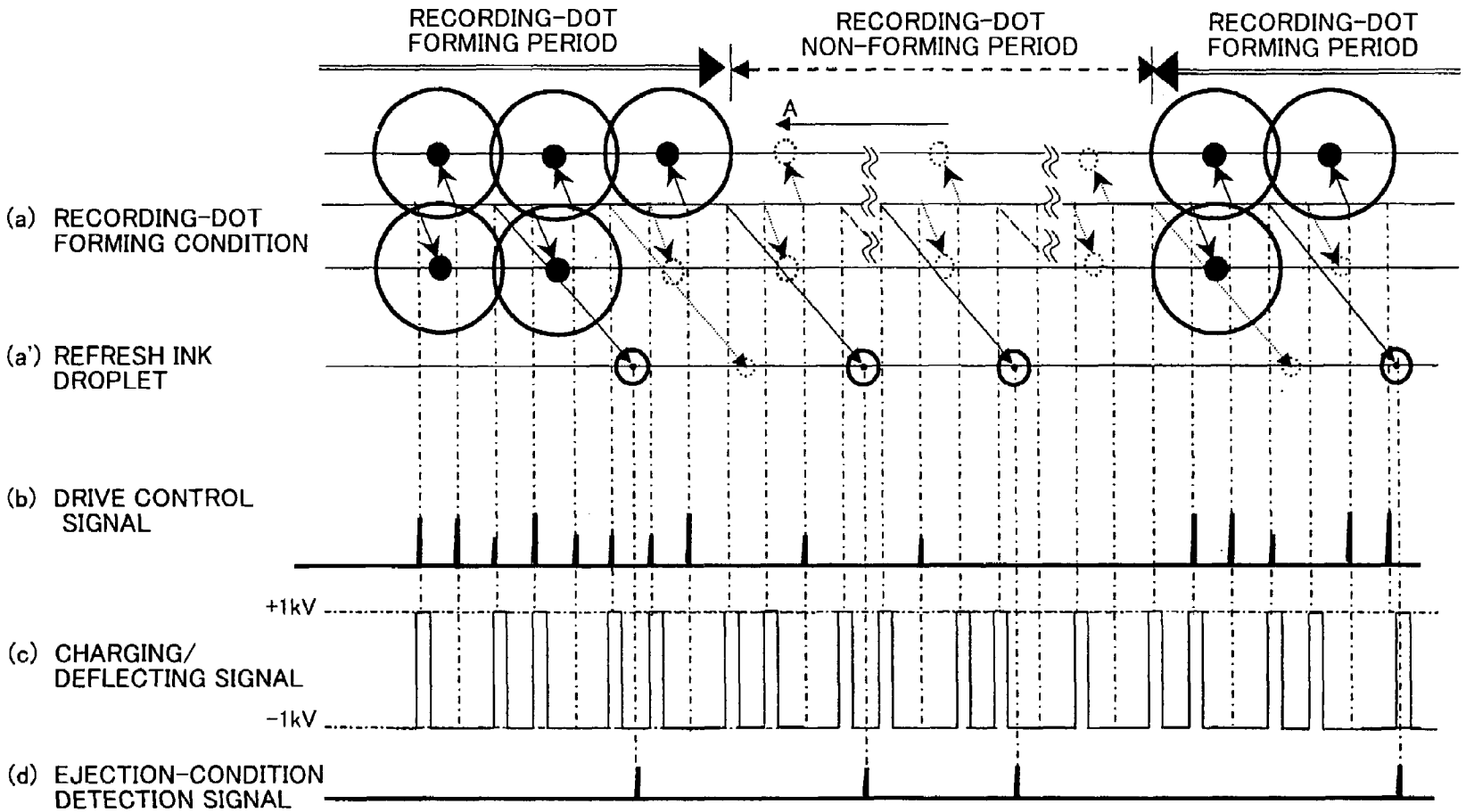
FIG. 8(*a*) shows recording dots formed on a recording medium.
Figure 9:
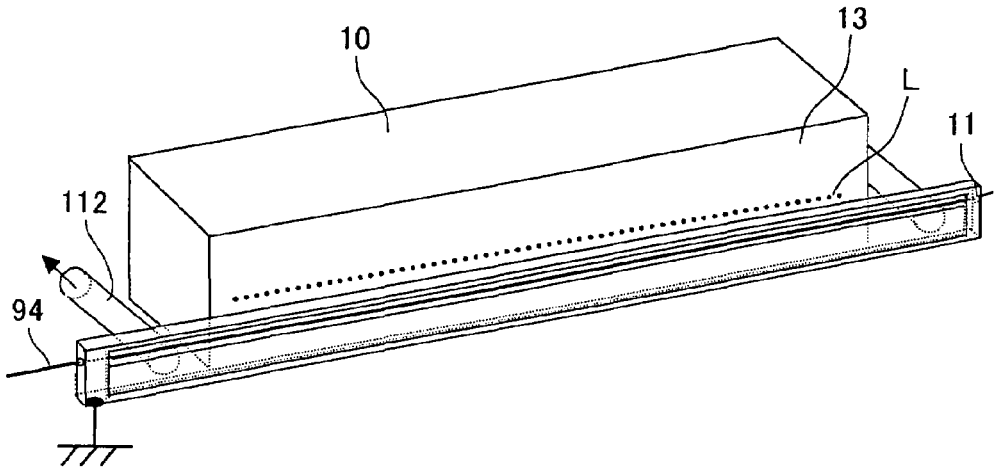
Figure 10:
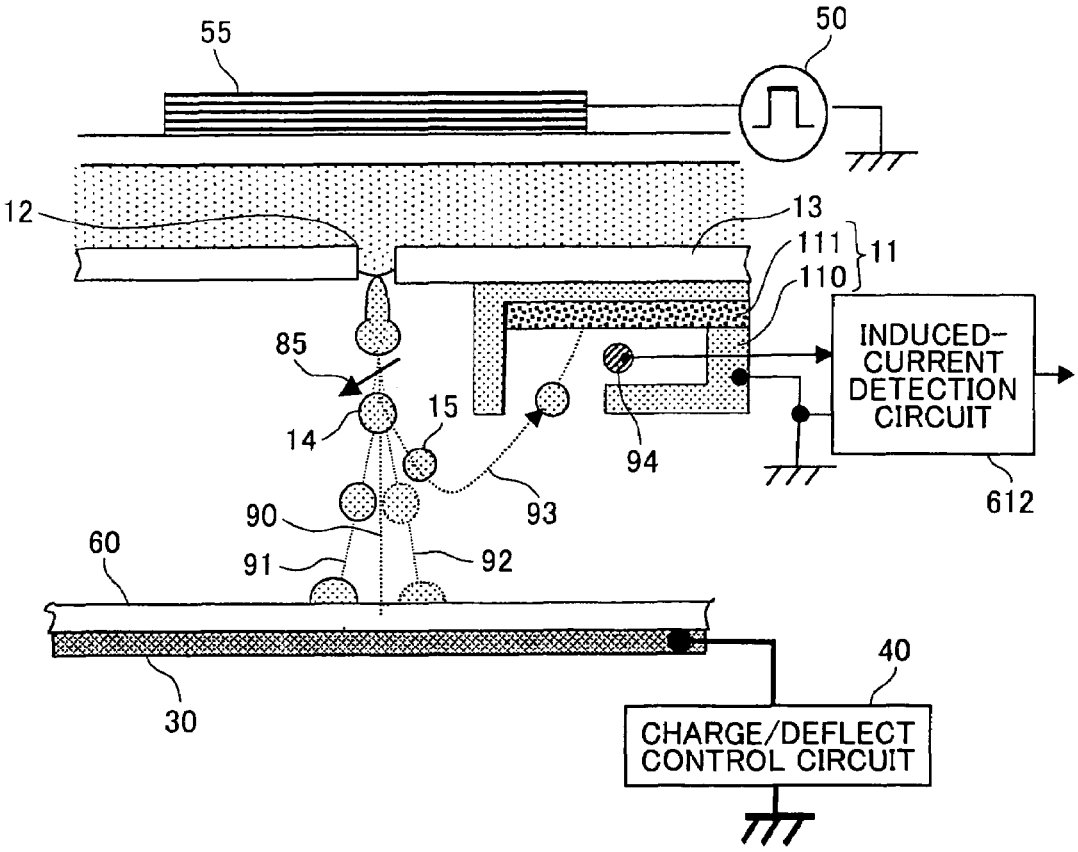
Figure 11:
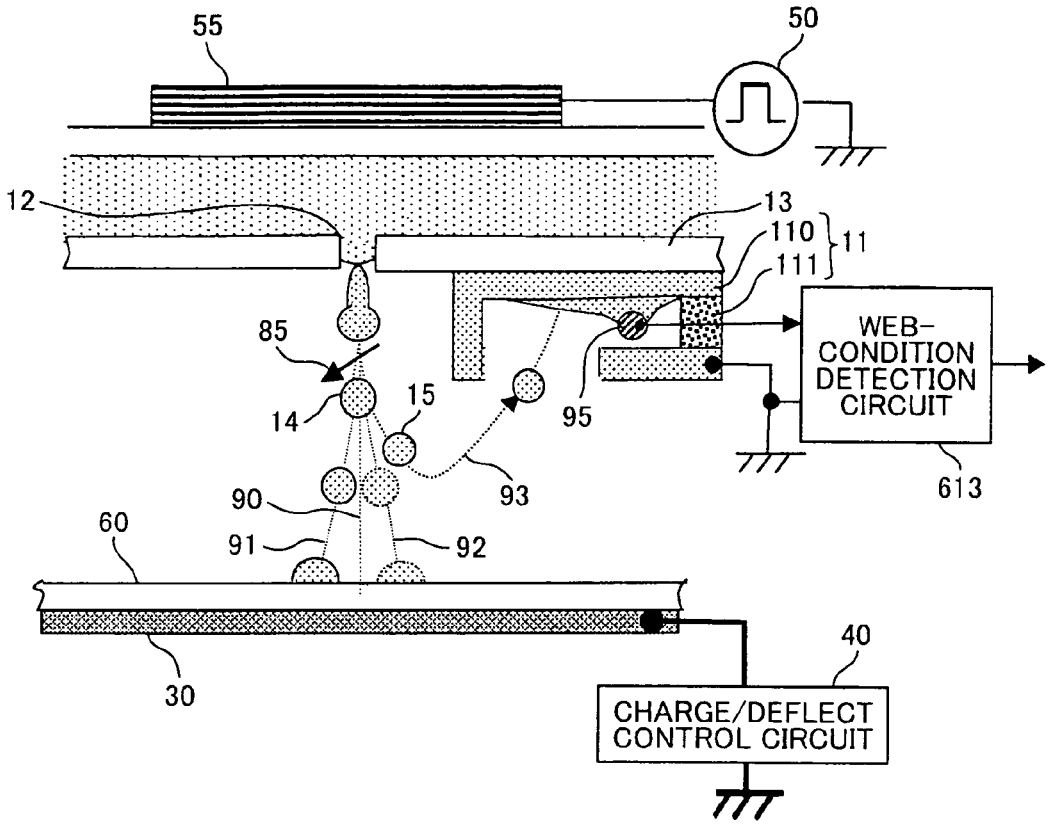
Figure 12:
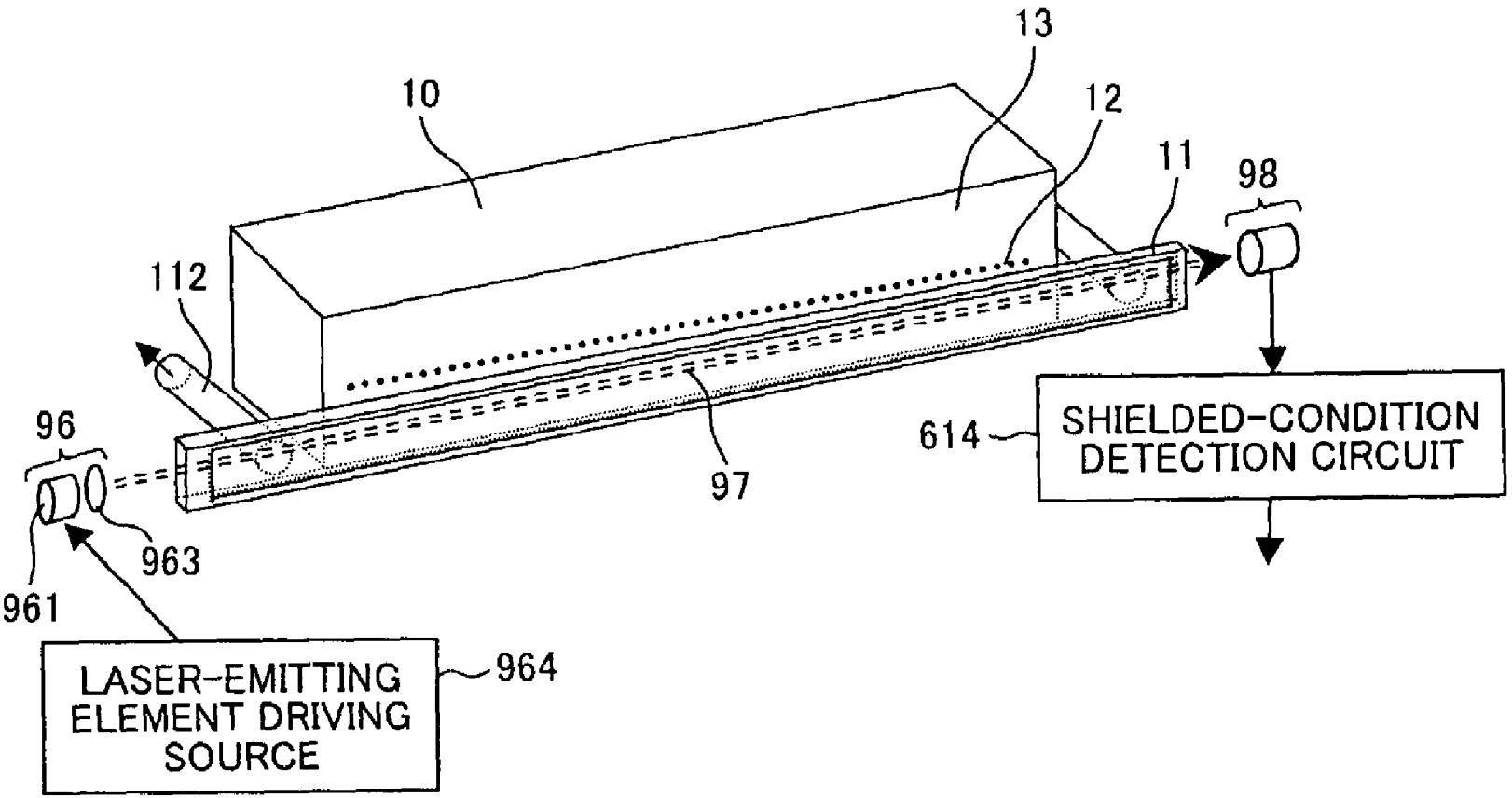
Figure 13:
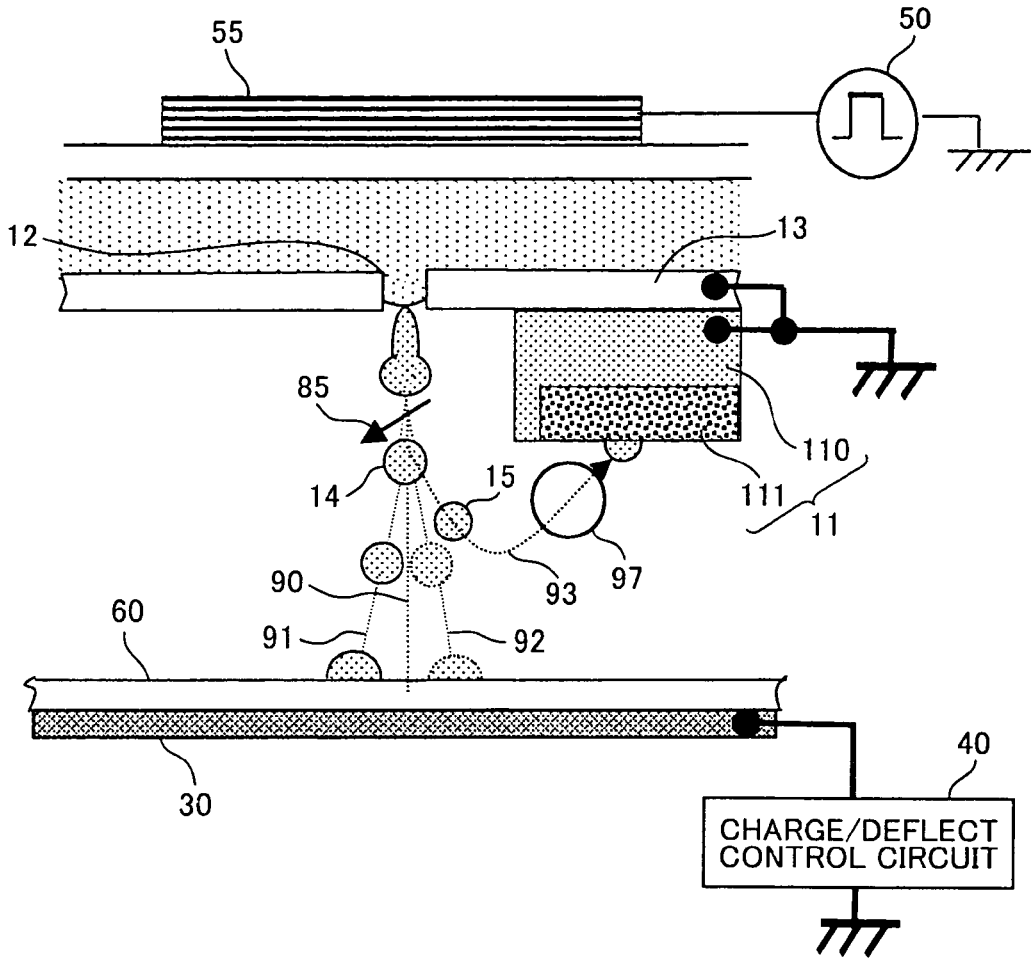

5 FIG. 8(*c*) is a timing chart showing a charging/deflecting signal applied to the back electrode;

FIG. 8(*d*) is a timing chart showing a detection signal output from the refresh-ink ejection condition detection circuit;

FIG. 9 is a perspective view of a head module according to a first modification of the embodiment;

FIG. 10 is a cross-sectional view of the head module of FIG. 9;

FIG. 11 is a cross-sectional view of a head module according to a second modification of the embodiment;

FIG. 12 is a perspective view of a head module according to a third modification of the embodiment; and FIG. 13 is a cross-sectional view of the head module of FIG. 12.

PREFERRED EMBODIMENTS OF THE PRESENT INVENTION

Next, an inkjet printer including an ejection condition detection device according to an embodiment of the present invention will be described with reference to accompanying drawings.

Figure 1:
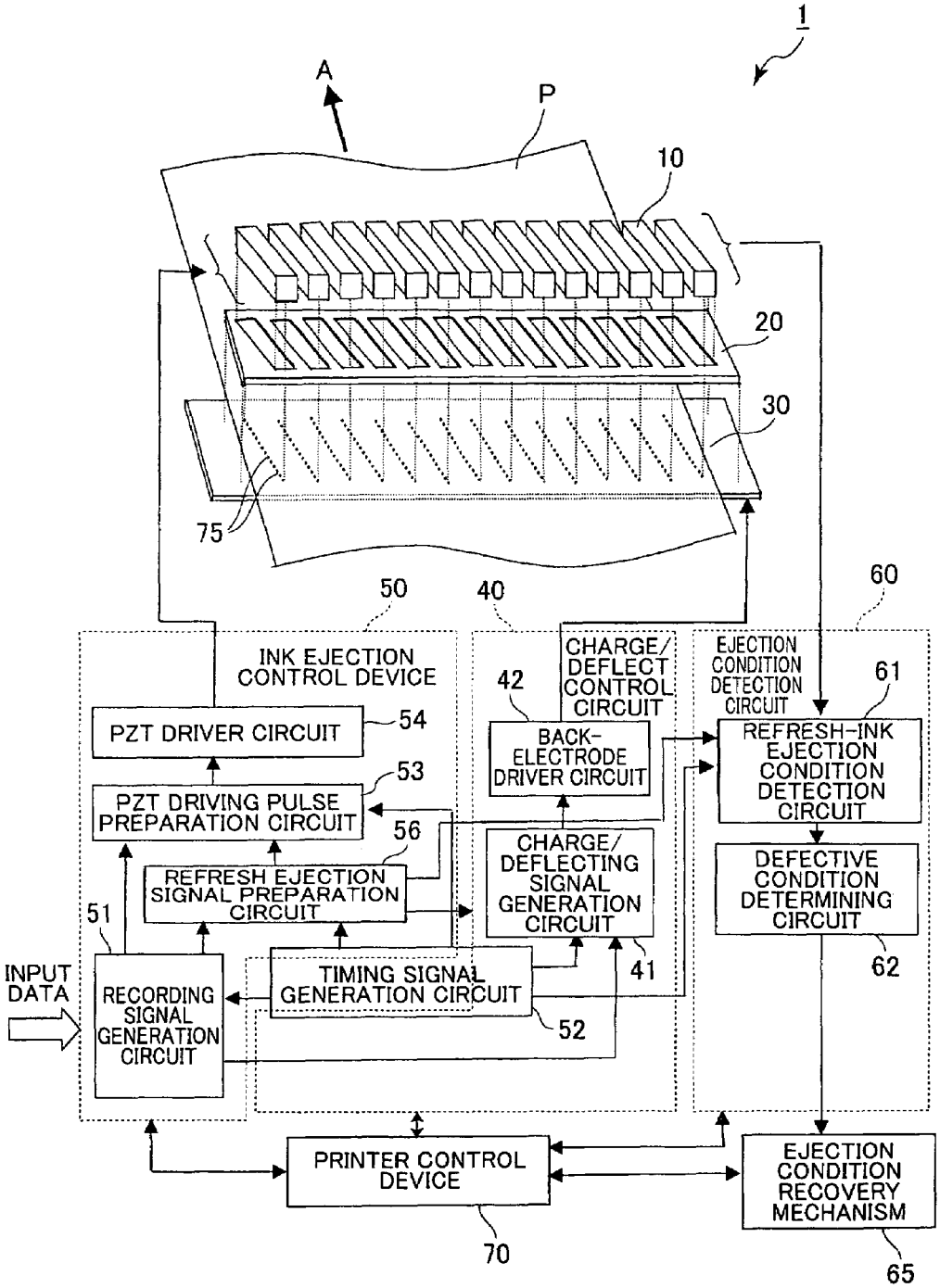
FIG. 1 is schematic view showing a drop-on-demand type inkjet printer provided with an ejection-condition detection device according to an embodiment of the present invention.

FIG. 1 shows an inkjet printer 1 that includes an ejection condition detection device of the present embodiment. The inkjet printer 1 is an ink-deflection type drop-on-demand line scan inkjet printer. As shown in FIG. 1, the inkjet printer 1 includes a plurality of head modules 10, a module mounter 20, a back electrode 30, a charge/deflect control circuit 40, an ink ejection control device 50, an ejection condition detection circuit 60, an ejection condition recovery mechanism 65, and a printer control device 70.

The plurality of head modules 10 are arranged side by side and mounted on the module mounter 20. A sheet feed mechanism (not shown) transports a recording sheet P in a sheet feed direction A.

The back electrode 30 is disposed in confrontation with the module mounter 20 on the opposite side of a sheet transport path than the module mounter 20 so that the back electrode 30 locates behind the recording sheet P. The charge/deflect control circuit 40 is for generating and supplying charging/deflecting signals to the back electrode 30. The ink ejection control device 50 is for controlling ink ejection based on an input data received from an external device.

The charge/deflect control circuit 40 includes a charging/deflecting signal generation circuit 41 and a back-electrode driver circuit 42. The ink ejection control device 50 includes a recording signal generation circuit 51, a timing signal generation circuit 52, a PZT driving pulse preparation circuit 53, a PZT driver circuit 54, and a refresh ejection signal preparation circuit 56.

The timing signal generation circuit 52 is for generating a timing signal. The recording signal generation circuit 51 generates a recording signal based on input data. The refresh ejection signal preparation circuit 56 prepares a refresh ejection signal. The PZT driving pulse preparation circuit 53 generates a print-driving pulse based on the recording signal from the recording signal generation circuit 51 and also generates a refresh-driving pulse based on the refresh ejection signal from the refresh ejection signal preparation circuit 56. The print-driving pulse and the refresh-driving pulse are both output to the PZT driver circuit 54 as drive-control signals. The PZT driver circuit 54 amplifies the drive-control signals to a suitable level for driving an actuator 55 (FIG. 3) and outputs the same to the actuator 55.

Figure 5:
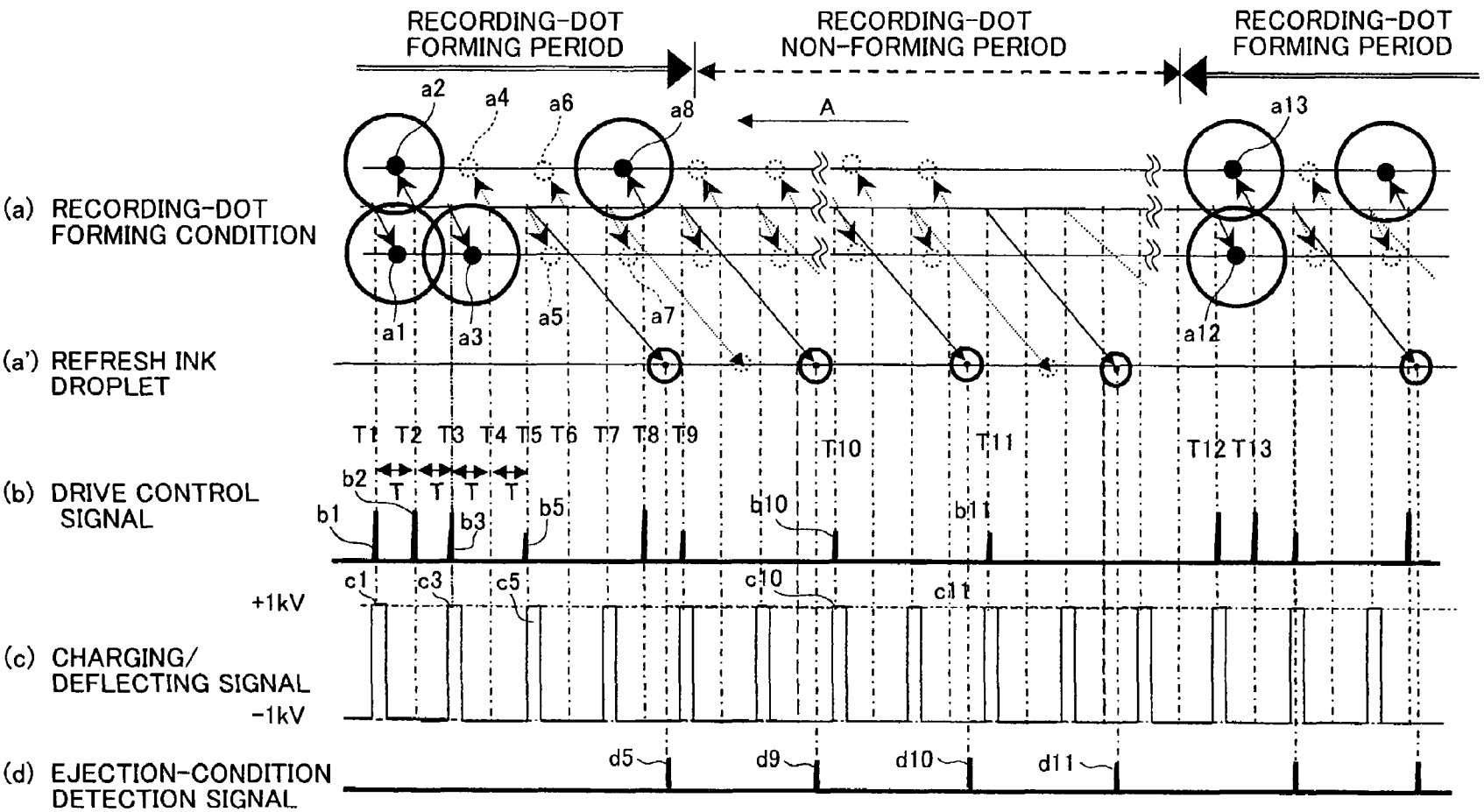
FIG. 5(*a*) shows recording dots formed on a recording sheet.

The charging/deflecting signal generation circuit 41 generates a charging/deflecting signal based on the timing signal, the recording signal from the recording signal generation circuit 51, and the refresh ejection signal from the refresh ejection signal preparation circuit 56. The back-electrode driver circuit 42 amplifies the charging/deflecting signal to a predetermined level and then outputs the same to the back electrode 30. As shown in FIG. 5(*c*), the charging/deflecting signal periodically changes between +1KV and −1KV.

The ejection condition detection circuit 60 is provided one for each head module 10. That is, the ejection condition detection circuit 60 is in one-to-one correspondence with the head module 10. The ejection condition detection circuit 60 is for detecting ink ejection condition of the corresponding head module 10 and includes a refresh-ink ejection condition detection circuit 61 and a defective-condition determining circuit 62 to be described later. The ejection condition recovery mechanism 65 performs a well-known purging or wiping operation to recover a proper condition of the inkjet printer 1 and also performs compensating printing wherein a normal nozzle performs printing in place of a defective nozzle so that any part of printed image will not be lost due to the defective nozzle.

The printer control device 70 is for controlling the charge/deflect control circuit 40, the ink ejection control device 50, the ejection condition detection circuit 60, and the ejection condition recovery mechanism 65.

Figure 2:
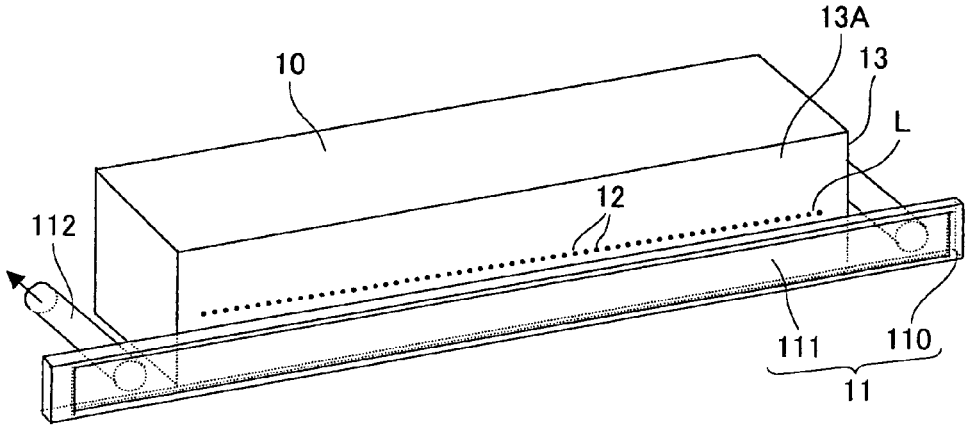
FIG. 2 is a perspective view of one of head modules of the inkjet printer of FIG. 1.

Next, configuration of the head module 10 will be described with reference to FIGS. 2 and 3. As shown in FIG. 2, each head module 10 includes an orifice plate 13 made of conductive member, such as metal. An orifice surface 13A of the orifice plate 13 is formed with n-number of nozzles 12 aligned equidistance from one another, defining a nozzle line L. An orifice electrode/ink receiving member 11 is disposed on the orifice surface 13A in parallel with the nozzle line L. A gap between the orifice electrode/ink receiving member 11 and the nozzle line L is set to about 200 μm.

The orifice electrode/ink receiving member 11 includes a plate 110 made of conductive material, such as a metal, to a thickness of about 0.25 mm and an ink absorbing member 111 embedded in the plate 110. The ink absorbing member 111 has a thickness of about 0.15 mm. The orifice electrode/ink receiving member 11 serves as an inclined electric field generation electrode, a refresh ink receiving member, and an ejection condition detection electrode. The ink absorbing member 111 could be a plate made of stainless steel fibers or a porous stainless steel of sintered compact. The ink absorbing member 111 is connected to ink absorbing pipes 112 at both sides. Ink impinged on the ink absorbing member 111 spreads due to capillary action and is discharged outside through the ink absorbing pipe 112. As shown in FIG. 3, the orifice electrode/ink receiving member 11 and the orifice plate 13 are both connected to the ground via a current-voltage converter/amplifier 611.

Figure 3:
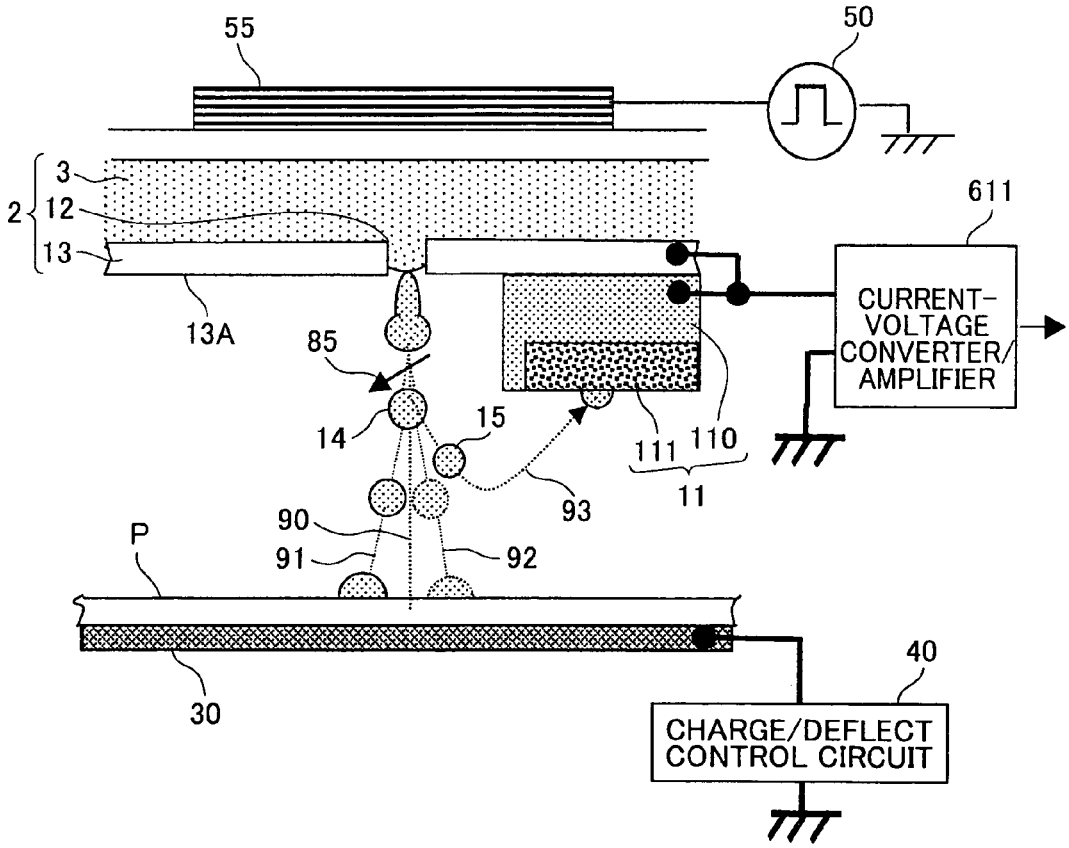
FIG. 3 is a cross-sectional view of the inkjet printer.

The head module 10 is a drop-on-demand inkjet linear head module and has n-number of nozzle elements 2 (only one nozzle element 2 is shown in FIG. 3). The nozzle elements 2 have the same configuration, and each has the orifice 12 formed in the orifice plate 13, a pressure chamber 3, and the actuator 55, such as a PZT piezoelectric element. The pressure chamber 3 has the orifice 12 as its opening end and houses ink therein. The actuator 55 is attached to the pressure chamber 3. The drive control signal generated by the ink ejection control device 50 is input to the actuator 55. Although not shown in the drawings, each head module 10 is further formed with ink inlet ports for introducing ink to the pressure chambers 3 and a manifold for supplying ink to the ink inlet ports.

When the drive control signal from the ink ejection control device 50 is applied to the actuator 55, then the actuator 55 changes the volume of the pressure chamber 3 in accordance with the drive control signal, thereby ejecting an ink droplet through the corresponding orifice 12. In the present embodiment, the nozzle 12 has a diameter of about 30 μm. When the drive control signal from the ink ejection control device 50 is the print-driving pulse, then a recording ink droplet 14 with a mass of about 15 ng is ejected at a velocity of 5 m/s. On the other hand, when the drive control signal is the refresh-driving pulse, then a refresh ink droplet 15 with a mass of about 10 ng is ejected at a velocity of 4 m/s. Thus ejected ink droplets 14, 15 will fly straight along an undeflected trajectory 90 and impinge on the recording sheet P if not deflected. However, in the present embodiment, the ink droplets 14, 15 are deflected as described later.

As shown in FIG. 3, the back electrode 30 is a thin plate formed of a conductive material, such as metal, and is disposed parallel with the orifice surface 13A at a position 1.5 mm separated from the orifice surface 13A. As mentioned previously, the back electrode 30 is applied with a charging/deflecting signal from the charge/deflect control circuit 40, so that the back electrode 30 has an electric potential depending on the voltage of the charging/deflecting signal. Because the voltage of the charging/deflecting signal changes between +1KV and −1KV in this embodiment, the electric potential of the back electrode 30 changes between +1KV and −1KV also.

Figure 4:
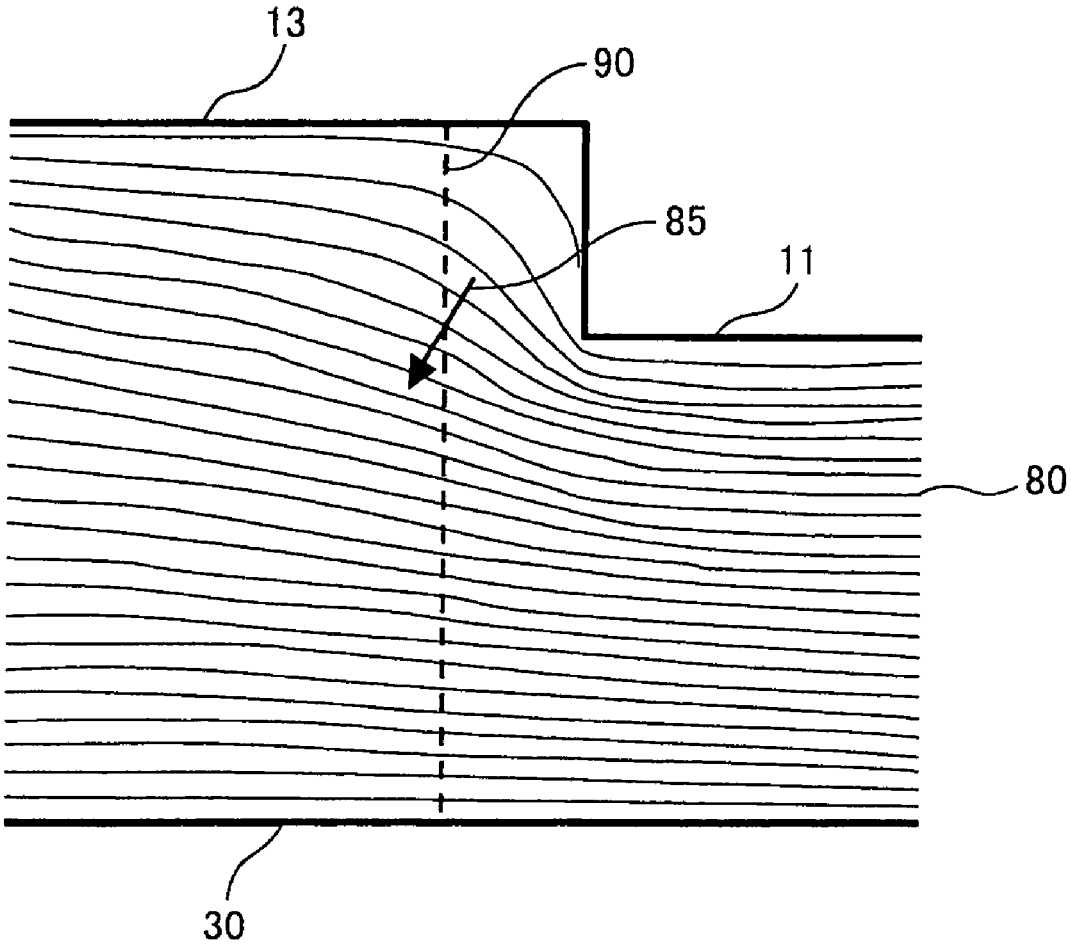
FIG. 4 is a view showing an equipotential surface of an electric field.

The orifice electrode/ink receiving member 11 and the orifice plate 13 are both conductive and connected to the ground. Thus, when the back electrode 30 is applied with the charging/deflecting signal, an electric field is generated between the orifice electrode/ink receiving member 11 and the orifice plate 13 and the back electrode 30. FIG. 4 shows an equipotential surface 80 of the electric field. As shown in FIG. 4, with the electrode arrangement of the present embodiment, the direction of the electric field is angled with respect to an ink ejection direction near the undeflected trajectory 90, thereby forming an inclined electric field 85.

Accordingly, in FIG. 3, the ink droplets 14, 15 are electrically charged in accordance with the charging/deflecting signal when ejected, and deflected to a direction perpendicular to the undeflected trajectory 90 by the inclined electric field 85. More specifically, ink to be ejected from the nozzle 12 is charged to a positive or negative polarity by a predetermined amount depending on the electric potential of the back electrode 30 at the time of ejection. Then, an ejected ink droplet, which is electrically charged, flies while changing its flying direction due to deflecting effect of the inclined electric field 85. Here, a positively charged recording ink droplet 14 is deflected to the left in FIG. 3 by the inclined electric field 85 and follows a trajectory 91. On the other hand, a negatively charged recording ink droplet 14 is deflected to the right in FIG. 3 by the inclined electric field 85 and follows a trajectory 92. That is, by controlling ejection and non-ejection of recording ink droplets 14 and by controlling the deflect direction of the recording ink droplets 14, recording dots 75 (FIG. 1) are formed at desired positions on the recording sheet P, thereby obtaining a desired image on the recording sheet P.

Here, as will be understood from FIG. 4, the inclined electric field 85 is largely inclined with respect to the undeflected trajectory 90 at early flying stage of ink droplets (i.e., a location close to the nozzle 12). Accordingly, recording ink droplets 14 are deflected greatly from the early flight stage, and so even greater deflection can be achieved as the flight proceeds, so that it is possible to effectively deflect the charged ink droplets 14. It should be noted that the charged ink droplets 14 are accelerated or decelerated depending on the polarity of the charged ink droplets 14 due to the inclined electric field 85.

The refresh ink droplets 15 are negatively charged when ejected and impinge on the ink absorbing member 111 of the orifice electrode/ink receiving member 11 after following a U-turn trajectory 93. This is because the refresh ink droplet 15 is lighter in its weight and ejected at a lower speed in comparison with the recording ink droplet 14, and so the refresh ink droplet 15 is deflected by the inclined electric field 85 by a greater amount. The refresh ink droplet 15 impinged on the ink absorbing member 111 is discharged outside through the ink absorbing pipe 112.

In this manner, the orifice electrode/ink receiving member 11 functions both as an electrode for generating the inclined electric field 85 and a receiver for receiving refresh ink droplets 15. Therefore, it is unnecessary to provide an electrode for generating the inclined electric field 85 separately from a receiver for receiving refresh ink droplets 15. As a result, it is possible to maintain the distance between the head modules 10 and the recording sheet P small, enabling printing of high-quality images.

Next, a recording operation of the inkjet printer 1 according to the present embodiment will be described with reference to a specific example shown in FIG. 5.

In this example, recording ink droplets 14 are ejected from a single nozzle 12 and deflected while a recording sheet P is transported at a constant speed. As shown in FIG. 5, a recording-dot-forming period during which recording dots 75 are formed on the recording sheet P and a recording-dot non-forming period during which no recording dots 75 are formed on the recording sheet P are alternatively repeated. Here, the recording-dot non-forming period includes, for example, periods between letters, between ruled lines, and between graphics where no recording dots 75 are formed. The recording-dot non-forming period also includes a recording sheet transporting period between pages where no recording dots 75 are formed.

FIG. 5(*a*) shows recording dots 75 formed on the recording sheet P, and FIG. 5(*a*') shows refresh ink droplets 15. FIG. 5(*b*) shows the drive control signals (print-driving pulse and refresh-driving pulse) from the ink ejection control device 50. FIG. 5(*c*) shows the charging/deflecting signal generated in the charge/deflect control circuit 40. It should be noted that the recording sheet P is transported in a direction indicated by an arrow A at a constant speed by a transporting mechanism (not shown).

First, in a first recording-dot-forming period, a print-driving pulse b1 is applied to the actuator 55 at a time T1 shown in FIG. 5(*b*). As a result, a recording ink droplet 14 is ejected through the orifice 12 slightly after the time T1. At this time, as shown in FIG. 5(*c*), a charging/deflecting signal c1 of +1KV is being applied to the back electrode 30, so that the recording ink droplet 14 ejected in response to the pulse b1 is negatively charged, and flies toward the recording sheet P. During the flight, as shown in FIG. 5(*c*), the charging/deflecting signal is switched to −1KV. As a result, the charged recording ink droplet 14 is deflected by the inclined electric field 85, flies along the trajectory 92 shown in FIG. 3, and forms a recording dot 75 on the recording sheet P at a dot position a1 (FIG. 5(*a*)). Here, the recording ink droplet 14 is decelerated during its flight.

When a time period T elapses, as shown in FIG. 5(*b*), a print driving pulse b2 is applied to the actuator 55 at a time T2. As a result, a recording ink droplet 14 is ejected slightly after the time T2. At this time, a charging/deflecting signal of −1KV (FIG. 5(*c*)) is being applied to the back electrode 30, so that the recording ink droplet 14 ejected in response to the pulse b2 is positively charged. Because the charging/deflecting signal is maintained at −1KV while the positively charged recording ink droplet 14 is flying, the recording ink droplet 14 is deflected by the inclined electric field 85 and flies along the trajectory 91 shown in FIG. 3. Eventually, the recording ink droplet 14 impinges on the recording sheet P and forms a recording dot 75 at a dot location a2 (FIG. 5(*a*)). In this case, the recording ink droplet 14 is accelerated during the flight.

When a next time duration T elapses, a print-driving pulse b3 is applied to the actuator 55 at a time T3 (FIG. 5(*b*)), so that a recording dot 75 is formed at a dot location a3 (FIG. 5(*a*)) in the same manner as at the time T1. However, no print-driving pulse is applied to the actuator 55 at time T4 to time T7 (FIG. 5(*b*)), so that no recording ink droplet 14 is ejected. Accordingly, no recording dot 75 is formed on at dot locations a4 to a7 shown in FIG. 5(*a*).

Repeating the operations in this manner provides a desired image shown in FIG. 5(*a*) on the recording sheet P.

As mentioned above, no recording dot 75 is formed at the time T5. In the present embodiment, a refresh ink droplet 15 is generated at this recording-dot not-forming timing. That is, at time T5, a refresh-driving pulse b5 (FIG. 5(*b*)) is applied to the actuator 55. Because the voltage of the refresh-driving pulse b5 is set smaller than that of the print-driving pulses b1 and b2, it is possible to eject a light refresh ink droplet 15 at a reduced ejection speed compared to the recording ink droplets 14. The refresh ink droplet 15 is negatively charged by charging/deflecting signal c5 of +1KV, and impinges on the ink absorbing member 111 after following the U-turn trajectory 93. The refresh ink droplet 15 follow the U-turn trajectory 93 for the following reasons. That is, the negatively charged refresh ink droplet 15 flies straight toward the recording sheet P at the beginning. However, the refresh ink droplet 15 is decelerated by the inclined electric field 85 thereafter, and forced back toward the orifice plate 13. At the same time, the refresh ink droplet 15 is deflected in a direction perpendicular to the ejection direction by the inclined electric field 85.

It should be noted that if the voltage of the charging/deflecting signal c5 or the like for the refresh ink droplets 15 is set greater than that of the charging/deflecting signal c1 or the like for the recording ink droplets 14, then the charging amount of the refresh ink droplets 15 increases. In this case, the refresh ink droplets 15 make U-turn more easily, and it is possible to reliably collect the refresh ink droplets 15 by the ink absorbing member 111, effectively preventing the refresh ink droplets 15 from impinging on the recording sheet P by an accident.

When the charged refresh ink droplet 15 ejected at time T5 impinges the orifice electrode/ink receiving member 11, then an electric discharge occurs, thereby generating an electric current. The refresh-ink ejection condition detection circuit 61 detects the electric current by the current-voltage converter/amplifier 611 and outputs a detection signal d5 shown in FIG. 5(*d*). The defective-condition determining circuit 62 determines ink-ejection condition based on the voltage value of the detection signal.

That is, if the nozzle element 2 is incapable of ejecting ink droplets, then no refresh ink droplet 15 is ejected. If an ink droplet ejected from the nozzle element 2 is misdirected to a wrong direction, then the refresh ink droplet 15 ejected from the nozzle element 2 does not impinge on the orifice electrode/ink receiving member 11. Therefore, in these cases, the current-voltage converter/amplifier 611 cannot detect any generation of an electric current, and so the refresh-ink ejection condition detection circuit 61 does not output a detection signal.

Also, if a splash occurs due to abnormal ink ejection, then ink mists may impinge on the orifice electrode/ink receiving member 11. In this case, small electric current or abnormally large electric current would be generated. Accordingly, the voltage value of the detection signal becomes smaller or greater than a normal value, or the voltage value may fluctuate greatly.

Therefore, by monitoring the detection signal from the refresh-ink ejection condition detection circuit 61 by the defective-condition determining circuit 62, it is possible to determine an ink ejection condition of each nozzle element 2.

If it is determined that the ink ejection is abnormal, then the defective-condition determining circuit 62 outputs a notification signal to the printer control device 70 shown in FIG. 1. Then, the printer control device 70 stops the recording operation and controls the ejection condition recovery mechanism 65 to perform a predetermined recovery operation. Alternatively, the printer control device 70 could stop only using a defective nozzle element 2 and use different nozzle element 2, such as the nozzle element 2 adjacent to the defective nozzle element 2, for the defective nozzle element 2 such that recording dots allocated for the defective nozzle element 2 are formed by the different nozzle element 2.

In the example shown in FIG. 5, a refresh ink droplet 15 is ejected at time T9 in the same manner at time T5. Thereafter, the process enters the recording-dot non-forming period. In this period, refresh ink droplets 15 are ejected at time T10 and T11. As a result, detection signals d9, d10, and d11 (FIG. 5(*d*)) are output, and it is determined that the corresponding nozzle element 2 is normal.

As mentioned above, in the recording-dot non-forming period, no recording ink droplet 14 is ejected from the nozzle 12. Therefore, there is a danger that ink clinging around the nozzle 12 gets dry and condensed. If the ink gets dry, then a recording ink droplet 14 that is ejected at the beginning of the next recording-dot-forming period (for example, the droplets 14 ejected at time T12, T13, or the like) may be ejected unstably, causing improper printing.

However, according to the present embodiment, refresh ink droplets 15 are ejected at T10, T11 and the like during the recording-dot non-forming period as mentioned above. Therefore, ink clinging near the nozzle 12 is prevented from getting dry and condensed. This makes possible to properly and stably eject the recording ink droplet 14 even at the beginning of the next recording-dot-forming period, such as at time T12 and T13. Thus, recording dots 75 can be formed precisely at dot locations a12 and a13 (FIG. 5(*a*)). Here, preventing increase in ink viscosity by ejecting the refresh ink droplet 15 is called "refresh effect".

Figure 6:
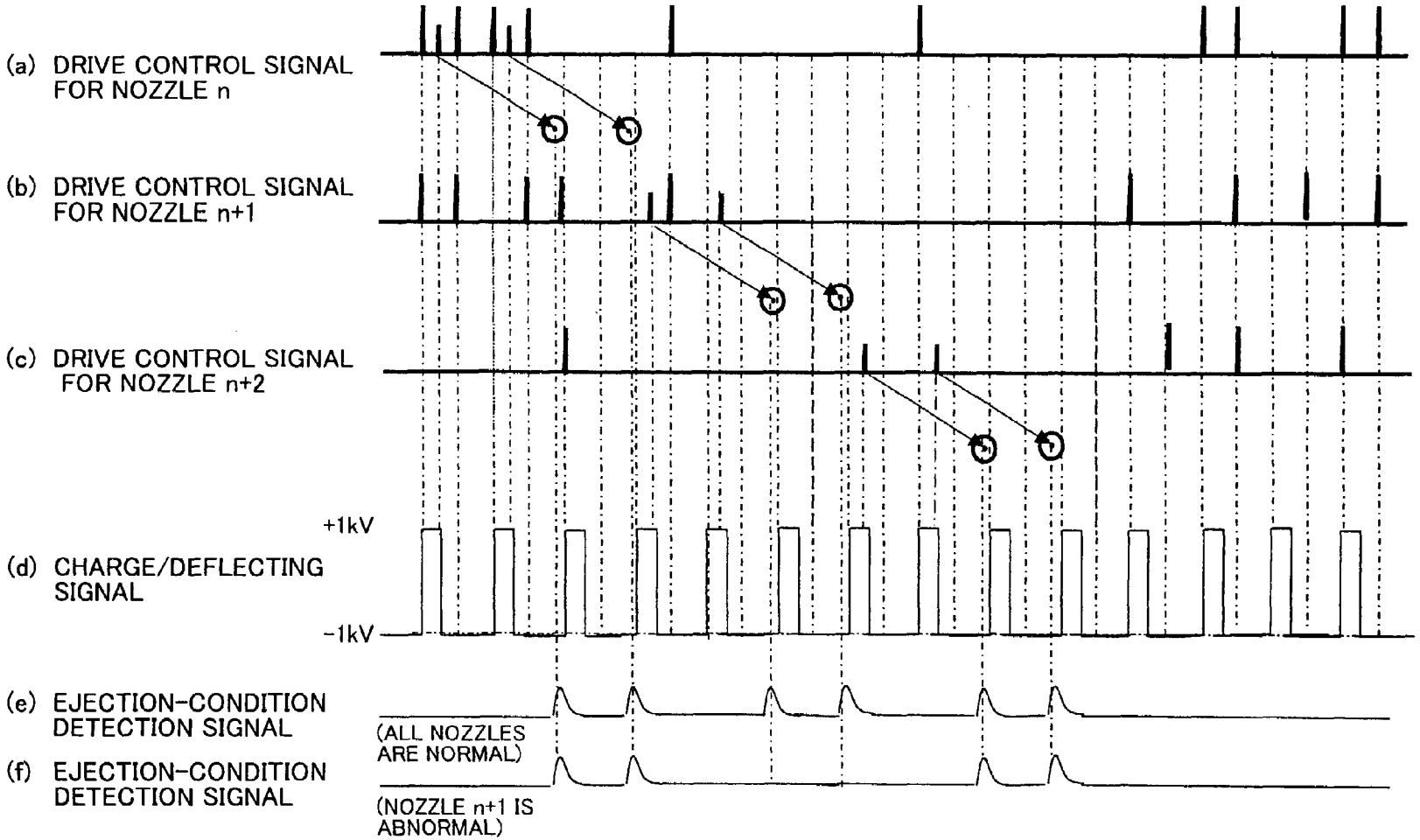
FIG. 6(*a*) is a timing chart showing ideal ejection timing of refresh ink droplets for a nozzle n.

Next, an ejection timing of the refresh ink droplet 15 will be described with reference to FIGS. 6(*a*) to 6(*f*). In this description, three adjacent nozzle elements 2 are referred to as nozzle n, nozzle n+1, and nozzle n+2, and ejection timings of the refresh ink droplets 15 for these nozzles n, n+1, and n+2 are shown in FIGS. 6(*a*), 6(*b*), and 6(*c*), respectively. FIG. 6(*d*) shows a charging/deflecting signal applied to the back electrode 30. It should be noted that the ejection timing of the refresh ink droplet 15 is controlled by the refresh ejection signal preparation circuit 56.

In the present embodiment, as described above, the orifice electrode/ink receiving member 11 is provided common to all the nozzle elements 2 of the corresponding head module 10. Therefore, as shown in FIG. 6(*a*) to 6(*c*), the refresh ink droplet 15 is ejected at different timing from each of the nozzle elements 2. In this manner, for example, if all the nozzle elements 2 are normal, then a detection signal shown in FIG. 6(*e*) is obtained. However, if the nozzle n+1 is defective, then a detection signal shown in FIG. 6(*f*) is obtained. That is, as shown in FIG. 6(*f*), a portion corresponding to the nozzle n+1 is missing from the detection signal.

In this manner, by differing the ejection timing of the refresh ink droplet 15 among the nozzle elements 2, it is possible to detect ejection condition of each one of the nozzle elements 2 even if the ejection condition detection circuit 60 is only provided common to all the nozzle elements 2. Because it is possible to detect ejection condition of all the nozzle 12 by only using single ejection condition detection circuit 60, the configuration of ink-ejection condition detection device can be simple, reducing manufacturing costs.

Also, according to the present embodiment, two refresh ink droplets 15 are successively ejected from each one of the nozzle elements 2. When a plurality of refresh ink droplets 15 are successively ejected, output of the detection signal increases compared with when only one refresh ink droplet 15 is ejected, so that stability of detection is enhanced. The detection signal can be stabilized by providing the refresh-ink ejection condition detection circuit 61 with integration function or the like.

The number of refresh ink droplets 15 successively ejected is not limited to two, but could be three or more. However, if the time interval between successively ejected two refresh ink droplets 15 is too small, then the refresh ink droplets 15 interfere and repel each other during flight. This may cause a problem in that properly-ejected refresh ink droplet 15 does not impinge on the orifice electrode/ink receiving member 11. Therefore, it is necessary to secure a suitable interval between refresh ink droplets 15. For this reason, in the example shown in FIG. 5, a refresh ink droplet 15 is ejected at T9 after a previous refresh ink droplet 15 is ejected at T5, but no refresh ink droplet 15 is ejected at T7.

In the recording-dot forming period and also in the recording-dot forming period after the recording-dot non-forming period, ejection timings of refresh ink droplets 15 are restricted because recording ink droplets 14 are ejected in these periods. However, in the recording-dot non-forming period, refresh ink droplets 15 can be ejected at sufficient frequency and at desirable timings shown in FIG. 6 because no recording ink droplet 14 is ejected during this period.

Figure 7:
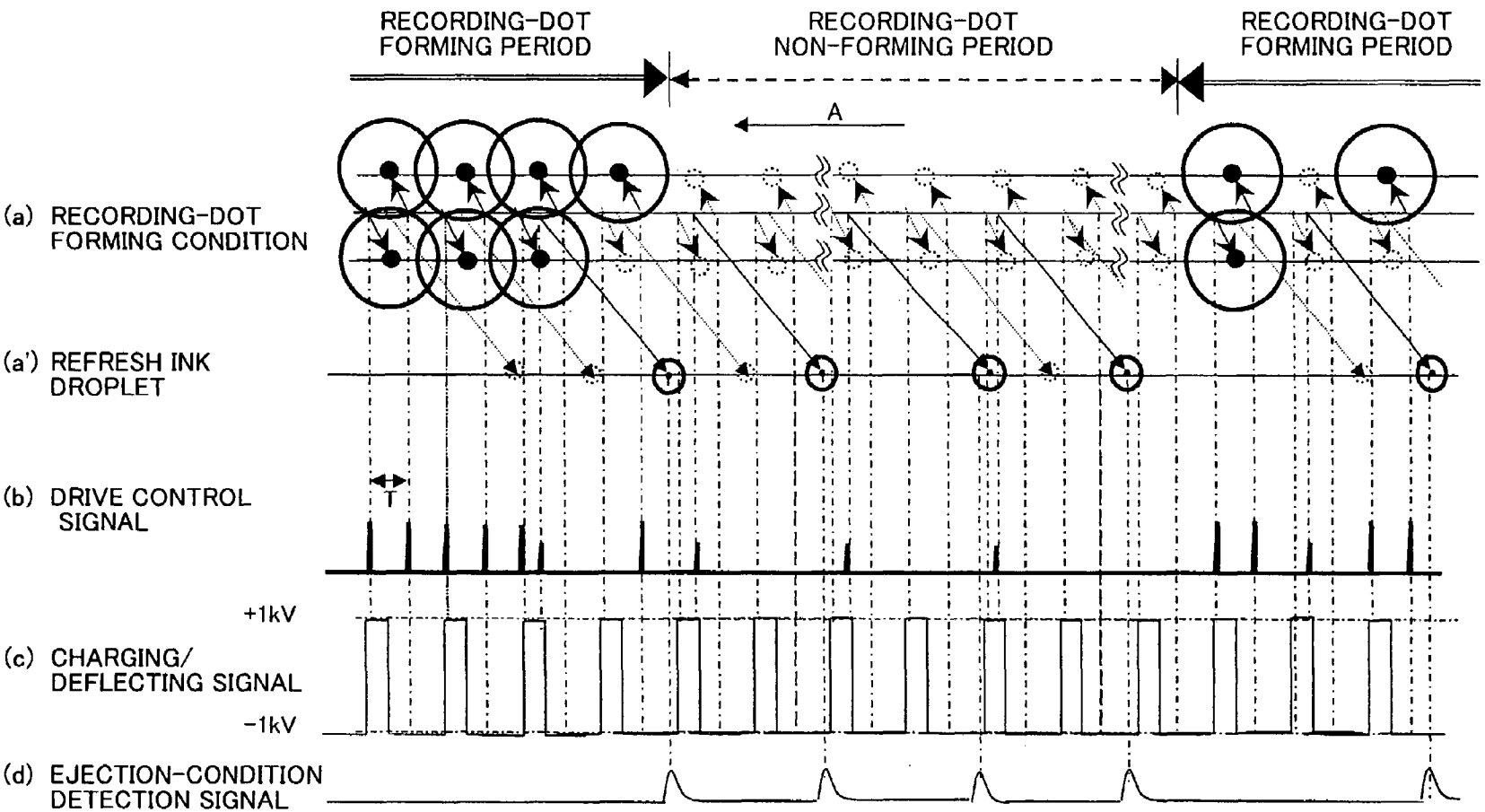
FIG. 7(*a*) shows recording dots formed on a recording sheet.

Ejection timings of refresh ink droplets 15 are not limited to that shown in FIG. 5. For example, as shown in FIGS. 7(*a*) to 7(*d*), refresh ink droplets 15 could be ejected between ejection timings of recording ink droplets 14. In this case, refresh ink droplets 15 can be ejected at desirable timing regardless of ejection or non-ejection of recording ink droplets 14. That is, the refresh ink droplets 15 can be ejected at ideal timing shown in FIG. 6 even in the recording-dot ejection period, so that ejection condition can be detected at desirable timing even during when recording dots 75 are successively formed, enhancing reliability of ejection-condition detection.

Alternatively, as shown in FIGS. 8(*a*) to 8(*d*), it is possible to allocate two of successive three ejection timings for recording ink droplet 14 and remaining one of the successive three ejection timings for a refresh ink droplet 15. In this case also, it is possible to eject refresh ink droplet 15 even during when recording dots 75 are successively formed, thereby enhancing reliability of ejection-condition detection. In this case, however, it is necessary to adjust the angle of the head modules 10 with respect to the sheet feed direction A.

As described above, according to the present embodiment, ink ejection condition of the nozzle elements 2 can be detected by ejecting the refresh ink droplet 15 without stopping recording operation of the inkjet printer 1, and also the refresh effect can be achieved at the same time. Further, because the ejection condition is determined based on the refresh ink droplet 15, reliability of determination is high, and ink-droplet ejection condition detection device suitable for high-speed line scan inkjet printer for printing on continuous sheets can be provided. Moreover, by providing a high-speed inkjet printer with the detection device of the present embodiment, it is possible to minimize defective printing due to poor ink-ejection condition, thereby realizing a high-speed inkjet printer capable of reliably printing high-quality images.

Next, a first modification of the present embodiment will be provided with reference to FIGS. 9 and 10. Each head module 10 according to this modification is provided with an induced-current detection electrode 94 in addition to the above-described components. The induced-current detection electrode 94 has a line shape with a diameter of 40 μm and extends parallel to the nozzle line L. The induced-current detection electrode 94 is provided inside the orifice electrode/ink receiving member 11 near the U-turn trajectory 93 and electrically isolated from the orifice electrode/ink receiving member 11. Also, the refresh-ink ejection condition detection circuit 61 is provided with an induced-current detection circuit 612 instead of the current-voltage converter/amplifier 611. The induced-current detection circuit 612 is connected to the induced-current detection electrode 94. The refresh ink droplet 15 passes by the induced-current detection electrode 94 and impinges on the orifice electrode/ink receiving member 11. Because the refresh ink droplet 15 is electrically charged, charge in reverse polarity is induced to the induced-current detection electrode 94 at the time of when the refresh ink droplet 15 passes by the induced-current detection electrode 94, thereby generating induced current. The refresh-ink ejection condition detection circuit 61 detects the induced current by the induced-current detection circuit 612 and outputs a detection signal accordingly.

If ejected properly, a refresh ink droplet 15 passes by the induced-current detection electrode 94, so that an induced current is generated. However, if ejected improperly, then a refresh ink droplet 15 does not pass by the induced-current detection electrode 94, so that no induced current is generated. In this manner, ink-ejection condition of the nozzle elements 2 can be detected. It should be noted that because the induced-current detection electrode 94 is disposed inside the orifice electrode/ink receiving member 11, this configuration generates less noise compared to the above-described configuration.

Next, a second modification of the present embodiment will be described with reference to FIG. 11. In this modification, a wet-condition detection electrode 95 is disposed inside the orifice electrode/ink receiving member 11. The 95 has a line-shape with a diameter of 40 μm and extends parallel to the nozzle line L. The wet-condition detection electrode 95 is electrically isolated from the orifice electrode/ink receiving member 11. The refresh-ink ejection condition detection circuit 61 is provided with a wet-condition detection circuit 613 instead of the current-voltage converter/amplifier 611. The wet-condition detection circuit 613 is connected to the wet-condition detection electrode 95.

With this configuration, a refresh ink droplet 15 having impinged on the plate 110 of the orifice electrode/ink receiving member 11 is drawn toward the ink absorbing member 111 due to a negative pressure generated by the ink absorbing pipe 112 and then absorbed into the ink absorbing member 111. At this time, the wet-condition detection electrode 95 is connected to the plate 110 via the ink, so that an electric resistance drops between the wet-condition detection electrode 95 and the plate 110. Therefore, by measuring the change in the electric resistance by the wet-condition detection circuit 613, it is possible to detect whether or not a refresh ink droplet 15 has impinged on the orifice electrode/ink receiving member 11, and ejection condition can be determined based on the detection result. This configuration also generates less noise.

Next, a third modification of the embodiment will be described with reference to FIGS. 12 and 13. In this modification, a light emitter 96 and a light receiver 98 are provided at both ends of each head module 10. The refresh-ink ejection condition detection circuit 61 is provided with a shielded-condition detection circuit 614 instead of the current-voltage converter/amplifier 611. The shielded-condition detection circuit 614 is connected to the light receiver 98. The light emitter 96 includes a laser emitting element 961 and a lens 963. The laser emitting element 961 emits a light flux 97 when driven by a laser-emitting element driving source 964. The light flux 97 passes parallel to the orifice electrode/ink receiving member 11 through the U-turn trajectory 93 and enters the light receiver 98. If a refresh ink droplet 15 passes through a center area of the light flux 97 (region within about 200 μm from the center of the light flux 97), then the amount of light received by the light receiver 98 changes, and the shielded-condition detection circuit 614 detects this change. Accordingly, if the light amount changes properly, then the ejection condition is determined normal. On the other hand, if the light amount does not change properly, then the ejection condition is detected abnormal.

The configuration of this modification generates less noise than that of first or second modification. It should be noted that the light emitter 96 and the light receiver 98 could be attached to the module mounter 20. Also, it is possible to change the place and the number of the light emitter 96 and the light receiver 98 by providing optical fibers, mirrors, lenses or the like for transmitting or distributing the light.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. A detection device for detecting ejection condition of an ejection member of a drop-on-demand type inkjet recording device, the detection device comprising:

a controller that controls the ejection member to eject a recording ink droplet or a refresh ink droplet, the recording ink droplet impinging on a recording medium;

a collector that collects the refresh ink droplet;

a deflection means that deflects at least the refresh ink droplet such that the deflected refresh ink droplet impinges on the collector, the refresh ink droplet being deflected by a greater amount than the recording ink droplet when a deflection power is applied to each of the refresh ink droplet and the recording ink droplet; and a detecting means that detects an ejection condition of the ejection member based on a condition of the refresh ink droplet as the refresh ink droplet is collected by the collector during impingement thereon as deflected by the deflection means.

2. The detection device according to claim 1, wherein the controller selectively controls the ejection member to eject a recording ink droplet at predetermined timings onto a recording medium, thereby forming a recording dot on the recording medium, and the controller controls the ejection member to eject the refresh ink droplet at a timing between the predetermined timings.

3. The detecting device according to claim 1, wherein the detecting means is provided common to all of a plurality of nozzles formed in the ejection member, and the controller controls the ejection member to eject the refresh ink droplet from the plurality of nozzles at different timings.

4. The detecting device according to claim 1, wherein the detecting means includes an electric current detector that detects an electric current which flows through the collector when the refresh ink droplet impinges on the collector.

5. The detecting device according to claim 1, wherein the detecting means includes an emitting member that emits a light flux that passes through a trajectory of the refresh ink droplet, a receiving member that receives the light flux emitted from the emitting member, and a detector that detects a shielding condition in which the light flux is shielded by the refresh ink droplet that flies along the trajectory.

6. The detecting device according to claim 1, wherein the collector and the deflection means are formed integral with each other.

7. The detecting device according to claim 1, wherein the detecting means includes a detector that detects a charging state of the refresh ink droplet.

8. The detecting device according to claim 7, wherein the detector includes an induced current detecting electrode provided near a trajectory of the refresh ink droplet and a current detector that detects an electric current generated in the induced current detecting electrode.

9. The detection device according to claim 1, wherein the detecting means includes a wetness detecting electrode disposed inside the collector and a detector that detects a clinging condition of the refresh ink droplet that clings on the wetness detecting electrode.

10. The detecting device according to claim 9, wherein the detector detects the clinging condition by detecting change in electric resistance between the wetness detecting electrode and the collector.

11. A drop-on-demand inkjet recording device comprising:

an ejection member for ejecting a refresh ink droplet;

a controller that controls the ejection member to eject a recording ink droplet or the refresh ink droplet, the recording ink droplet impinging on a recording medium;

a collector that collects the refresh ink droplet;

a deflection means that deflects at least the refresh ink droplet such that the deflected refresh ink droplet impinges on the collector, the refresh ink droplet being deflected by a greater amount than the recording ink droplet when a deflection power is applied to each of the refresh ink droplet and the recording ink droplet; and a detecting means that detects an ejection condition of the ejection member based on a condition of the refresh ink droplet as the refresh ink droplet is collected by the collector during impingement thereon as deflected by the deflection means.

12. The inkjet recording device according to claim 11, wherein the ejection member further ejects a recording ink droplet onto a recording medium, thereby forming a recording dot on the recording medium, and the controller selectively controls the ejection member to eject the recording ink droplet at predetermined timings and to eject the refresh ink droplet at a timing between the predetermined timings.

13. The inkjet recording device according to claim 11, wherein:

the ejection member is formed with a plurality of nozzles through which refresh ink droplets are ejected;

the detecting means is provided common to all the plurality of nozzles; and the controller controls the ejection member to eject the refresh ink droplet from the plurality of nozzles at different timings.

14. The inkjet recording device according to claim 11, wherein the detecting means includes an electric current detector that detects an electric current which flows through the collector when the refresh ink droplet impinges on the collector.

15. The inkjet recording device according to claim 11, wherein the detecting means includes an emitting member that emits a light flux that passes through a trajectory of the refresh ink droplet, a receiving member that receives the light flux emitted from the emitting member, and a detector that detects a shielding condition in which the light flux is shielded by the refresh ink droplet that flies along the trajectory.

16. The inkjet recording device according to claim 11, wherein the collector and the deflection means are formed integral with each other.

17. The inkjet recording device according to claim 11, wherein the detecting means includes a detector that detects a charging state of the refresh ink droplet.

18. The inkjet recording device according to claim 17, wherein the detector includes an induced current detecting electrode provided near a trajectory of the refresh ink droplet and a current detector that detects an electric current generated in the induced current detecting electrode.

19. The inkjet recording device according to claim 11, wherein the detecting means includes a wetness detecting electrode disposed inside the collector and a detector that detects a clinging condition of the refresh ink droplet that clings on the wetness detecting electrode.

20. The inkjet recording device according to claim 19, wherein the detector detects the clinging condition by detecting change in electric resistance between the wetness detecting electrode and the collector.

21. A drop-on-demand type inkjet recording device comprising:

an ejection member that ejects a refresh ink droplet;

a controller that controls the ejection member to eject the refresh ink droplet, said refresh ink droplet differing in weight, mass or speed from a recording ink droplet;

a collector that collects the refresh ink droplet;

a deflection member that deflects the refresh ink droplet in a manner different from a said recording ink droplet such that the deflected refresh ink droplet impinges on the collector; and a detecting member that detects a defective condition of the ejection member based on the refresh ink droplet.

22. The drop-on-demand type inkjet recording device according to claim 21, further comprising an ejection stop unit that stops ejection from the defective ejection member based on a detection result of the detecting member.

23. A detection device for detecting ejection condition of an ejection member of a drop-on-demand type inkjet recording device, the detection device comprising:

a controller that controls the ejection member to eject a recording ink droplet or a refresh ink droplet, said recording ink droplet being ejected from the ejection member with different weight, mass or speed from said refresh ink droplet;

a collector that collects the refresh ink droplet;

a deflection means that deflects at least the refresh ink droplet such that the deflected refresh ink droplet impinges on the collector and the recording ink droplet impinges on a recording medium; and a detecting means that detects an ejection condition of the ejection member based on a condition of the refresh ink droplet as the refresh ink droplet is collected by the collector during impingement thereon as deflected by said deflection means.

24. A drop-on-demand inkjet recording device comprising:

an ejection member for ejecting recording ink droplet or a refresh ink droplet;

a controller that controls the ejection member to eject the recording ink droplet or the refresh ink droplet, said recording ink droplet being ejected from the ejection member with different weight, mass or speed from said refresh ink droplets;

a collector that collects the refresh ink droplet;

a deflection means that deflects at least the refresh ink droplet such that the deflected refresh ink droplet impinges on the collector and the recording ink droplet impinges on a recording medium; and a detecting means that detects an ejection condition of the ejection member based on a condition of the refresh ink droplet as the refresh ink droplet is collected by the collector during impingement thereon as deflected by said deflection means.

25. A detection device for detecting ejection condition of an ejection member of a drop-on-demand type inkjet recording device, the detection device comprising:

a controller that controls the ejection member to eject a recording ink droplet or a refresh ink droplet, the recording ink droplet being ejected from the ejection member with different weight, mass or speed from the refresh ink droplet, and impinging on a recording medium;

a collector that collects the refresh ink droplet;

a deflection means that deflects at least the refresh ink droplet such that the deflected refresh ink droplet impinges on the collector; and a detecting means that detects an ejection condition of the ejection member based on a condition of the refresh ink droplet as the refresh ink droplet is collected by the collector during impingement thereon as deflected by the deflecting means.

26. A drop-on-demand inkjet recording device comprising:

an ejection member for ejecting a refresh ink droplet;

a controller that controls the ejection member to eject a recording ink droplet or a refresh ink droplet, the recording ink droplet being ejected from the ejection member with different weight, mass or speed from the refresh ink droplet, and impinging on the recording medium;

a collector that collects the refresh ink droplet;

a deflection means that deflects at least the refresh ink droplet such that the deflected refresh ink droplet impinges on the collector; and a detecting means that detects an ejection condition of the ejection member based on a condition of the refresh ink droplet as the refresh ink droplet is collected by the collector during impingement thereon as deflected by the deflecting means.

* * * * *